United States Patent [19]

Petreev et al.

[11] 4,036,309

[45] July 19, 1977

[54] DOUBLE-PISTON ROCK DRILL

[76] Inventors: Anatoly Mikhailovich Petreev, ulitsa Sibiryakov-Gvardeitsev, 8, kv. 59; Anatoly Alexeevich Lipin, ulitsa Vatutina, 17, kv. 9; Vladimir Davydovich Rabko, Krasny prospekt, 186, kv. 60; Gennady Ilich Suxov, ulitsa Sovetskaya, 47, kv. 22, all of Novosibirsk; Vladimir Ivanovich Kunegin, ulitsa Dzerzhinskogo, 3, kv. 17; Alexandr Safronovich Kurdjukov, ulitsa Karla Libknekhta, 113, kv. 26, both of Kyshtym Chelyabinskoi oblasti, all of U.S.S.R.

[21] Appl. No.: 664,000

[22] Filed: Mar. 4, 1976

Related U.S. Application Data

[63] Continuation of Ser. No. 584,930, June 9, 1975, abandoned.

[51] Int. Cl.[2] ..... B25D 9/06

[52] U.S. Cl. ..... 173/103; 91/186; 91/411 A; 92/33; 92/65

[58] Field of Search ..... 173/101, 102, 103, 97, 173/95, 96, 110, 111, 116, 118; 92/2, 31, 33, 6, 65; 91/411 A, 175, 186; 74/127

[56] References Cited

U.S. PATENT DOCUMENTS

| | | | |
|---|---|---|---|
| 841,139 | 1/1907 | Gibson | 93/33 |
| 1,039,704 | 10/1912 | Curtis | 92/65 X |
| 1,932,259 | 10/1933 | Warren | 173/111 X |

*Primary Examiner*—Ernest R. Purser
*Assistant Examiner*—William F. Pate, III

[57] ABSTRACT

A rock drill has a housing accommodating pistons defining working chambers. Rotary drive of a drill steel has an overrunning clutch and a screw pair. The screw pair is arranged between the pistons and is formed by outer and inner helical threads respectively provided on these pistons. One of the pistons is kinematically connected with the housing, and the other piston which cooperates, during the drilling, with a chuck receiving the drill steel shank is in force transmitting connection with the rotary drive of the drill steel.

The invention is aimed at lowering vibration of the rock drill housing by arranging the screw pair of the rotary drive between the pistons.

5 Claims, 6 Drawing Figures

DOUBLE-PISTON ROCK DRILL

This is a continuation of application Ser. No. 584,930 filed June 9, 1975 now abandoned.

The invention relates to pneumatic percussive tools, and in particular, to double-piston rock drills which may be used for drilling blast holes in the mining, in construction and other industries.

It is known that one of the major disadvantages of portable rock drills resides in a considerably vibration which is mainly due to the action of alternating air pressure forces on the rock drill housing and to the axial force component in the screw pair of a rotary drive.

Attemps were made to lower vibration of rock drills. The most effective solutions involved the development of double-piston rock drills having a barrel accommodating two pistons moving in opposition to each other during the operation of the tools. At least one of the pistons strikes against the drill steel.

In addition, in order to provide for rotation of the drill steel, one of the pistons has a helical groove which is received in a nut of the rotary drive mounted with an overrunning clutch in the rock drill housing. During the movement, this piston causes rotation of the drill steel. This construction permits the reduction of fluctuation of the resultant of compressed air pressure forces acting on the rock drill housing, but it cannot provide for reduction of the axial force component in the screw pair of the rotary drive acting on the rock drill housing. With fluctuating axial force component in the screw pair acting on the housing, the housing vibrations remains at a considerable level. This impairs the effect of utilization of double-piston rock drills.

Therefore, the problem might be solved by providing a double-piston rock drill in which the action of the axial force of the screw pair of the housing would be eliminated. One of the solutions to the problem might reside in complete elimination of the screw pair with the employment of an independent rotary drive. Thus, FRG Nos. 1057037 and 1175184 disclose double-piston rock drills wherein the pistons move in opposition to each other, and the drill steel is rotated by an independent auxillary motor. However, this solution is inexpedient for a portable rock drill, because the use of an additional independent rotary drive results in a heavier tool. This is inadmissible in portable rock drills. It is, therefore, desirable to find another solution to this problem, while retaining a screw rotary drive in the rock drill construction which is compact and provides for lowering the energy of piston strokes upon an increase in the resistance torque at the drill steel. This prevents the drill steel from being jammed during the drilling.

OBJECTS AND SUMMARY OF THE INVENTION

It is an object of the invention to provide a double-piston rock drill in which the action of the axial force component of the screw pair on the screw pair on the housing is eliminated.

This and other objects are accomplished by the provision of a double-piston rock drill with a rotary drive of a drill steel including an overrunning clutch a screw pair, comprising a housing accommodating pistons each having a head and a rod, said pistons dividing the inner space of the housing into working chambers, an air-distribution system for admitting compressed air to the working chambers and for discharging exhaust air into atmosphere, at least one of said pistons being adapted to strike against the shank of the drill steel, and one of the pistons cooperating, during the drilling, with a chuck receiving the shank of the drill steel, said piston being in force transmitting connection with said rotary drive of said drill steel. According to the invention, the other piston is kinematically connected with the rock drill housing so as to avoid their relative rotation at least in one direction, whereas the screw pair is arranged between the pistons and is formed by outer and inner helical threads respectively provided on these pistons.

With this construction of the rock drill, the axial force developed in the screw pair is applied to the piston and does not act on the rock drill housing thus considerably lowering vibration of the rock drill.

The piston, which is in force transmitting connection with the rock drill housing is preferably made composite of a central rod and a head forming with each other a rotating pair, the central rod being provided at one end thereof with a helical thread forming said screw pair with an inner helical thread of the other piston, and the other end of the central rod having straight splines cooperating with the rock drill housing via the overrunning clutch during the rotation of the drill steel.

The overrunning clutch is preferably coaxially mounted in the head of the piston which cooperates with the chuck during the drilling, whereas the inner helical thread of said piston which forms said screw pair with the helical thread of the other piston is preferably provided in the wall of the central bore of the overrunning clutch.

The above-mentioned structural arrangements provide for reduction of the load applied to the screw pair and make the latter more efficient.

It is also expedient to accommodate in the head of the piston cooprating with the chuck during the drilling the head of the other piston, and a device limiting, the amount of relative axial displacement of the pistons is preferably incorporated in the head of the former piston, said device being made as a mechanical abutment member.

The device limiting the amount of relative axial movement of the pistons is likewise preferably incorporated in the rod of the piston cooperating with the chuck during the drilling, said device being made as a mechanical abutment member.

These structural arrangements provide for reduction of the length of the helical thread on the piston rod, thereby reducing the mass of one of the pistons with the result that a lower feed force of the rock drill is required.

The present invention provides a double-piston rock drill eliminating the action of the axial force component of the screw pair of the rotary drive of the drill steel on the rock drill housing thus considerably reducing vibration of the latter, improving labour conditions for an operator, and productivity.

BRIEF DESCRIPTION OF THE DRAWINGS

The invention will now be described with reference to specific embodiments thereof taken in conjunction with the accompanying drawings, in which.

DETAILED DESCRIPTION OF PREFERRED EMBODIMENTS

Figure 1:
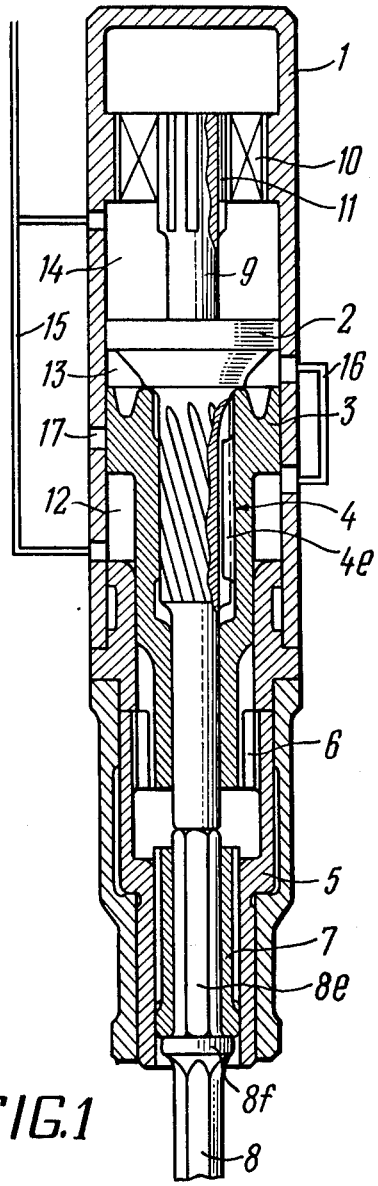
FIG. 1 shows a longitudinal section view of the double-piston rock drill according to the invention.

A housing 1 (FIG. 1) accommodates a piston 2 and a piston 3 forming a screw pair 4 due to the provision of helical treads on the rod of the piston 2 and on the inner surface of the piston 3. The outer surface of the piston 3 is provided with straight splines forming a movable splined connection 6 with splines of rotatable chuck 5 mounted in the front portion of the housing. A splined bush 7 is mounted in the chuck to receive a hexagonal shank 8*e* of a drill steel 8. In addition, the piston 2 is provided, on the outer surface of the rear rod 9 thereof with straight splines forming, together with splines of an overrunning clutch (ratchet-and-pawl mechanism) 10, a movable splined connecton 11. The inner space of the housing 1 is divided by the piston into working chambers: a front chamber 12, an intermediate chamber 13 and a rear chamber 14. A passage 15 establishes a permanent communication between the front and rear working chambers and between them and a compressed air source (not shown). A passage 16 communicates the intermediate working chamber 13 with the front working chamber 12 when the piston 3 is in the rearmost position. A port 17 communicates the intermediate working chamber 13 with atmosphere when the piston 3 is in the foremost position.

The rock drill operates in the following manner. In the position shown in FIG. 1 the pistons 2 and 3 collide with each other. In this position, the intermediate working chamber 13 communicates, via the passage 16, with the front working chamber 12 and with a compressed air source. The exhaust port 17 is closed by the piston 3. After the collision, the pistons move in mutually opposite directions. The piston 2 moves in the direction away from the drill steel after having received the energy from the piston 3 upon the collision, and the piston 3 moves in the direction towards the drill steel under the action of a force which is due to the fact that the area of the piston 3 at the side of the intermediate chamber 13 is greater than the area thereof at the side of the front working chamber 12. Forces applied to the piston 2 at the sides of the intermediate chamber 13 and rear chamber 14 are about equal to each other since the areas of the end forces of the piston in these chambers are about identical, and the compressd air pressure is also about the same. The piston 2 is prevented from rotation by the overrunning clutch 10, whereas the piston 3 is rotated about its axis due to the provision of the screw pair 4, thereby causing rotation of the drill steel via the splines connection 6 and the bush 7. Axial components of dynamic forces in the screw pair act only on the pistons and are not transmitted to the housing since the nut 4*e* of the screw pair 4 is connected to the piston 3, rather than to the housing of the rock drill. As the piston 3 continues its movement, it first closes the inlet passage 16 and then opens the exhaust port 17. The pistons start decelerating, and, if the resistance torque at the drill steel is low, the piston 3 can strike the splined bush 7 whose end face abuts against the shoulder 8*f* of the drill steel 8. Then the direction of movement of the pistons is changed for an opposite one. The piston 2 moves towards the drill steel under the action of a constant compressed air pressure in the rear chamber 14, and the piston 3 moves towards the piston 2 under the action of compressed air in the front chamber 12. It should be noted that the drill steel will not be rotated in the opposite direction due to the provisions of the overrunning clutch 10, and only the piston 3 rotates. An appropriate selection of the system parameters provides for an adequate phase shift in the pistons movement so that first the piston 2 completes its working stroke and strikes against the drill steel, and only thereupon the piston 3 at the end of its return stroke strikes the piston 2 to impart energy thereto required for return stroke thereof. Then the cycle is repeated.

Figure 2:
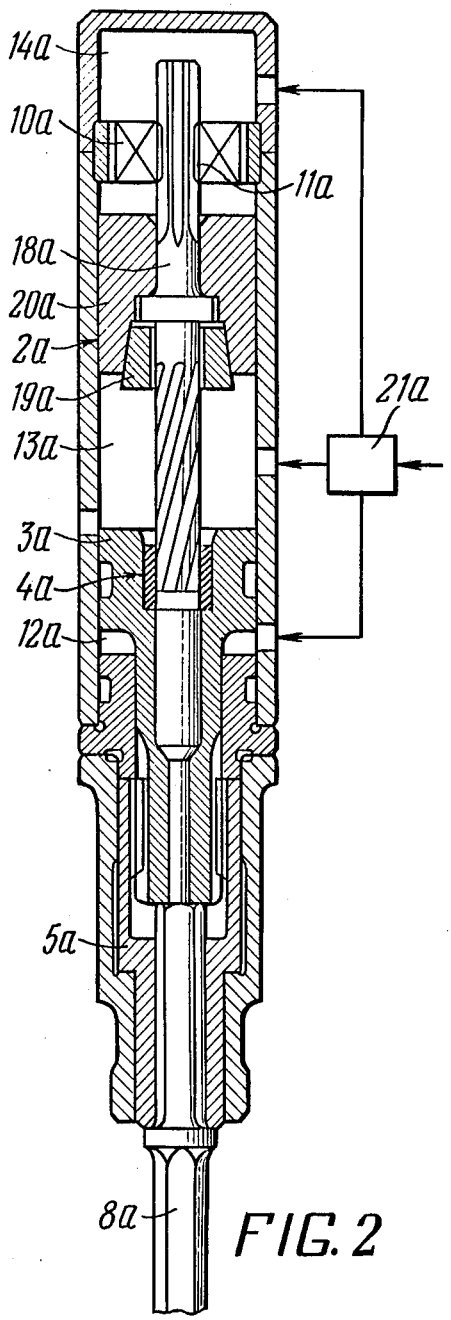
FIG. 2 shows a longitudinal section view of the double-piston rock drill according to the invention with one piston made opposite.

References to FIG. 1 were made mainly using numbers. In FIGS. 2–6 the same reference numbers are used which differ from those used in FIG. 1 only in literal indexes. Reference numbers in FIG. 2 are used with the literal index *a*. in FIGS. 3 and 4 - *b*, in FIG. 5 -*c* and in FIG. 6 -*d*.

The rock drill shown in FIG. 2 differs from that described with reference to FIG. 1 in that the piston 2*a* having an outer helical thread consists of a central rod 18*a* and a head 20*a*. The central rod 18*a* is made in the form of a stepped cylinder having a helical thread and splines forming a movable splined connection 11*a* with splines of the overrunning clutch 10*a*. The central rod 18*a* is axially fixed in the head 20*a* by means of a conical bush 19*a*. The control of compressed air supply to the working chambers of the rock drill in discharge of exhaust air into atmosphere is preformed by an air-distribution system incorporating an air-distribution device 21*a*.

The rock drill operates as follows. In the position of the pistons shown in FIG. 2, the intermediate chamber 13*a*is under atmospheric pressure, and the chamber 12*a*and 14*a* communicate, via the air-distribution device 21*a*, with a compressed air mainline. Under the action of compressed air pressure, the pistons move towards each other. The central rod 18*a* is prevented from rotation by the overrunning clutch 10*a*, and the piston 3*a* is rotated about its axis to the provision of the screw pair 4*a* thereby rotating the drill steel 8*a* via the chuck 5*a*. Upon collision of the pistons, the conical bush 19*a* is still more jammed in the head 20*a* of the piston 2*a* thus ensuring the reliable coupling. Axial components of dynamic forces in the screw pair act only on the pistons and are not transmitted to the housing After the compressed air has been discharge from the chambers 12*a* and 14*a* into atmosphere, and the air from the main-line has been admitted to the intermediate chamber 13*a* (as a result of actuation of the air-distribution device 21*a*), the pistons move away from each other in the piston opposite directions. The painting 3*a* strikes against the drill seel, and the central rod 18*a* of the piston 2*a* rotates in the overrunning clutch 10*a* relative to the head 20*a* of the piston 2*a*. Since the central rod 18*a* has a low moment of inertia with respect to the rotational axis, the forces developed in the screw pair 4*a* are low. This provides for reduced wear of the screw pair and improves the efficiency of the rotary drive.

Figure 3:
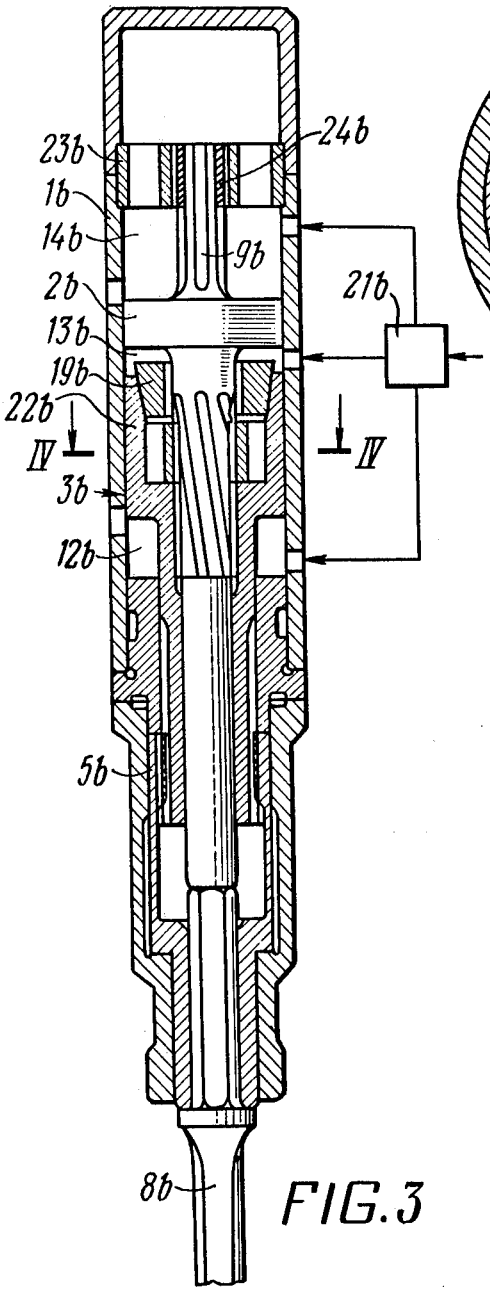
FIG. 3 shows a longitudinal section view of the double-piston rock drill according to the invention with an overrunning clutch mounted in the head of one of the pistons.
Figure 4:
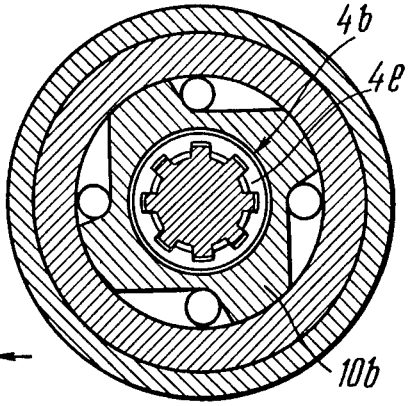
FIG. 4 is a sectional view taken along the line IV—IV in FIG. 3.

The rock drill shown in FIGS. 3 and 4 differs from that described with reference to FIG. 1 in that the overrunning clutch 10b is fitted in the head 22a of the piston 3b and in this case forms an integral part thereof, the inner helical thread (nut) 4e of said piston respectively forming the screw pair 4b being provided in the wall of the central bore of the overrunning clutch. The overrunning clutch and the nut are axially fixed in the head 22b of the piston 3b by means of a conical bush 19b. The outer surface 9b of the piston 2b is provided with straight splines which form a movable splined connection 24b with the splines of a ring 23b fixed in the housing 1b. The air-distribution device 21b controls the admission of compressed air to the working chambers.

The rock drill operates in the following manner. In the position of the pistons shown in FIG. 3, the chambers 12b and 14b are under atmospheric pressure, and the intermediate chamber 13b communicates with a compressed air mainline. Under the action of compressed air pressure in the chamber 13b, both pistons 2b and 3b move from each other in the opposite directions: the piston 2b moves away from the drill steel 8b, and the piston 3b moves towards the drill steel. The piston 2b is prevented from rotation by means of the ring 23b, and the overrunning clutch 10b (FIG. 4) connects the nut 4e to the head 22b of the piston 3b. While sliding along the helical thread of the piston 2b, the piston 3b is rotated about its axis to rotate the drill steel via the chuck 5b. Axial components of dynamic forces in the screw pair 4b act only on the pistons and are not transmitte to the housing. During the opposite movement of the pistons (after the chambers 12b and 14b has been connected to the compressed air mainline via the air-distribution device 21b and after the exhaust air has been discharged into atmosphere from the chamber 13b), the overrunning clutch 10b is actuated, and the drill steel will not rotate in the opposite direction, because in this case only the nut 4e rotates relative to the piston 3b, while the piston 2b does not rotate at all during the operation.

Since the nut 4e and the internal part of the overrunning clutch 10b have a low moment of inertia, the forces developed in the screw pair 4b are low. This reduces the wear of the screw pair and improves the efficiency of the rotary drive.

Figure 5:
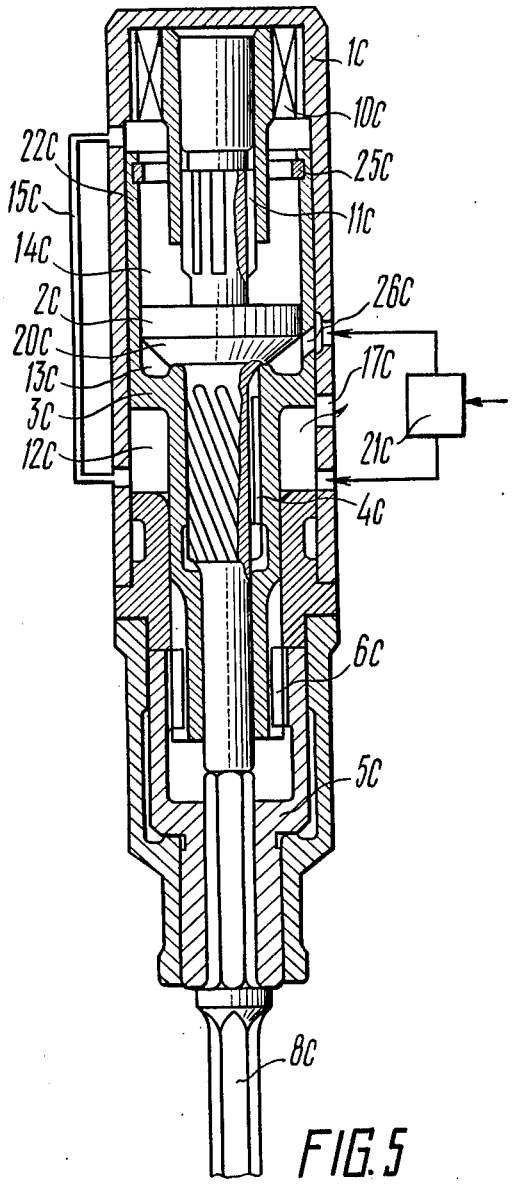
FIG. 5 is a longitudinal section of the double-piston rock drill according to the invention with a device limiting the amount of relative axial movement of the pistons incorporated in the head of one of the pistons.

The rock drill shown in FIG. 5 differs from that described with reference to FIG. 1 in that the head 20c of the piston 2c is located inside the head 22c of the piston 3c wherein a device 25c limiting the amount of relative axial movement of the pistons is incorporated. The control of compressed air supply to the working chambers of the rock drill and discharge of exhaust air into atmosphere is performed by an air-distribution system incorporating an air-distribution device 21c. The front chamber 12c and the rear chamber 14c are permanently interconnected via the passage 15c. An air passage 26c is made in the head 22c of the piston 3c.

The rock drill operates in the following manner. In the position of the pistons shown in FIG. 5, the chambers 12c and 14c are under atmospheric pressure, and the intermediate chamber 13c communicates, via the air passage 26c, with the compressed air mainline. Under the action of compressed air pressure in the chamber 13c, both pistons move away from each other in the opposite directions. The piston 2c is prevented from rotation by the overrunning clutch 10c, and the piston 3c is rotated about it axis due to the provision of the screw pair 4c to rotate, via the splined connection 6c, the chuck 5c and the drill steel 8c. Under certain conditions, such as in case where the resistance torque at the drill steel is low, the head 20c of the piston 2c will abut against the limiting device 25c thus preventing the screw pair 4c from disengaging. After the passage 26c has been brought in register with the exhaust port 17c, air is discharge from the intermediate chamber 13c. Compressed air is admitted via the air-distribution device 21c to the chambers 12c and 14c. The pistons start moving towards each other. The parameters of the system are such that before the piston 3copens the exhaust port 17c, the piston 2c strikes against the drill steel. Then the cycle is repeated.

The limiting device incorporated in the piston 3c permits the reduction of the length of the helical thread of the rod of the piston 2c, hence reduction of the length and mass of this piston.

Figure 6:
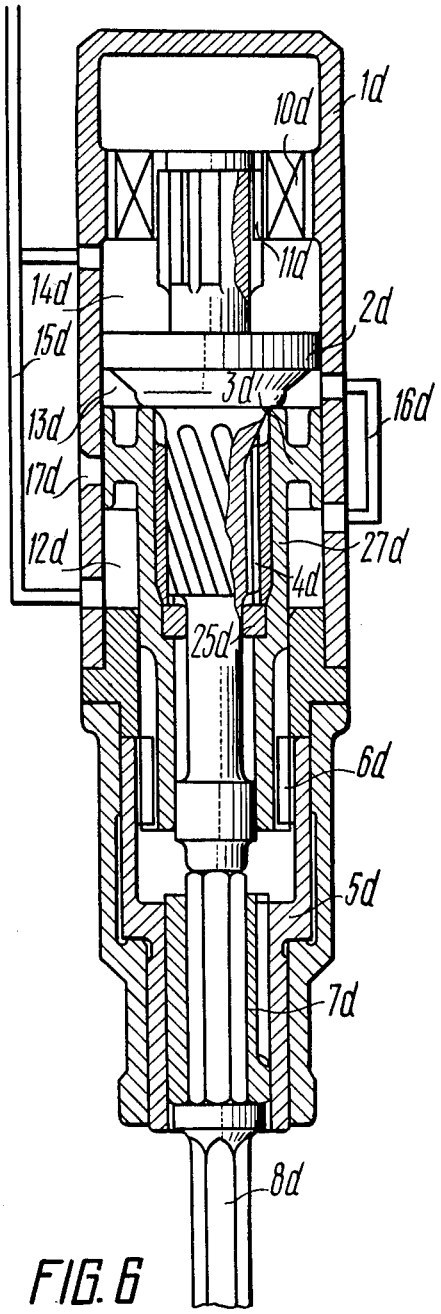
FIG. 6 shows the same rock drill, but with the limiting device incorporated in the piston rod.

The rock drill shown in FIG. 6 differs from that described with reference to FIG. 1 only in that it is provided with a device 25d limiting the amount of relative axial movement of the pistons which is incorporated in the rod 27d of the piston 3d.

This rock drill operates similarly to the rock drill shown in FIG. 1. It should be noted that the limiting device permits reduction of the length of the helical thread of the rod of the piston 2d, and hence reduction of the length and mass of the piston, thereby reducing the required feed force of the rock drill.

What we claim is:

1. A double-piston rock drill with a rotary drive of a drill steel including an overrunning clutch and a screw pair comprising a housing accomodating: pistons each having a head and a rod, said pistons dividing the inner space of said housing into chambers and one of said pistons having an appropriately arranged outer helical thread and the other said piston having an inner helical thread, said threads forming said screw pair, at least one of said pistons being adapted to strike against the shank of said drill steel; said overrunning clutch forming; together with said screw pair, rotary drive of said drill steel; an air distribution system for admitting compressed air to said chamber and for discharging exhaust air into atmosphere; a rotable chuck for receiving the shank of said drill steel arranged in the front portion of said housing; one of said pistons being in force transmitting connection with said rotary drive of said drill steel and cooperating, during the drilling, with said rotatable chuck of the drill steel, and the other of said pistons being kinematically connected with the rock drill housing so as to avoid their relative rotation at least in one direction.

2. The double-piston rock drill according to claim 1, wherein said piston, which is kinematically connected with said rock drill housing is made composite of a central rod and a head forming a rotating pair, said central rod having at one end thereof a helical thread forming said screw pair with an inner thread of said other piston, and the other end of said central rod having straight splines for cooperation with said rock drill housing via said overrunning clutch during the rotation of said drill steel.

3. A double-piston rock drill according to claim 1, wherein said overrunning clutch is coaxially mounted in said head of the piston cooperating with said chuck during the drilling whereas said inner helical thread of said piston which forms said screw pair with the helical thread of the other said piston is provided in the wall of the central bore of the overrunning clutch.

4. The double-piston rock drill according to claim 1, wherein said head of the piston cooperating with said rotatable chuck during the drilling accommodates said head of the other piston, said head of said first-mentioned piston incorporates a device limiting the amount of relative axial movement of said pistons, said device comprising a mechanical abutment member.

5. The double-piston rock drill according to claim 1, wherein said rod of the piston cooperating with said rotable chuck during the drilling incorporates a device limiting the amount of relative axial movement of the pistons, said device comprising a mechanical abutment member.

* * * * *